US007121355B2

(12) United States Patent
Lumpkins et al.

(10) Patent No.: US 7,121,355 B2
(45) Date of Patent: Oct. 17, 2006

(54) BULLDOZER AUTOGRADING SYSTEM

(75) Inventors: George T. Lumpkins, Katy, TX (US); Peter J. Dix, Naperville, IL (US); Daniel B. Shore, Prospect Heights, IL (US)

(73) Assignee: CNH America LLC, New Holland, PA (US)

( * ) Notice: Subject to any disclaimer, the term of this patent is extended or adjusted under 35 U.S.C. 154(b) by 0 days.

(21) Appl. No.: 10/947,002

(22) Filed: Sep. 21, 2004

(65) Prior Publication Data

US 2006/0070746 A1 Apr. 6, 2006

(51) Int. Cl.
*E02F 3/76* (2006.01)

(52) U.S. Cl. ..... 172/4.5; 172/7; 172/824; 172/826; 37/414

(58) Field of Classification Search ..... 172/2–4, 172/4.5, 7–12, 812, 824–826, 828, 829; 37/414–417
See application file for complete search history.

(56) References Cited

U.S. PATENT DOCUMENTS 4,807,131 A 2/1989 Clegg
4,923,015 A * 5/1990 Barsby et al. ..... 172/4.5
4,931,463 A 6/1990 Barbier et al.
5,321,643 A 6/1994 Nakagami et al.
5,462,122 A 10/1995 Yamamoto et al.
5,462,125 A * 10/1995 Stratton et al. ..... 172/826
5,485,885 A 1/1996 Matsushita et al.
5,499,684 A 3/1996 Stratton
5,503,232 A 4/1996 Matsushita et al.
5,515,927 A 5/1996 Matsushita et al.
5,535,830 A 7/1996 Matsushita et al.
5,551,518 A 9/1996 Stratton
5,555,942 A 9/1996 Matsushita et al.
5,564,507 A 10/1996 Matsushita et al.
5,572,809 A * 11/1996 Steenwyk et al. ..... 37/348
5,584,346 A * 12/1996 Sakamoto et al. ..... 172/4.5
5,620,053 A * 4/1997 Kamikawa et al. ..... 172/4
5,631,658 A 5/1997 Gudat et al.
5,694,317 A 12/1997 Nakagami et al.

(Continued)

FOREIGN PATENT DOCUMENTS

DE 3827617 A1 2/1990

(Continued)

*Primary Examiner*—Thomas B. Will
*Assistant Examiner*—Alexandra Pechhold
(74) *Attorney, Agent, or Firm*—Stephen A. Bucchianeri; John William Stader; Michael G. Harms

(57) ABSTRACT

A dozer blade control system controls the position of a bulldozer blade, maintaining the blade at a constant position as the dozer travels through a worksite. The control system monitors the angle of the dozer blade with respect to the earth and when it senses that the dozer blade is tilting, it corrects the dozer blade's position by extending or retracting hydraulic cylinders that couple the dozer blade to the chassis of the crawler-tractor. When the dozer chassis pitches forwards, the blade begins to tilt forward and to drop closer to the ground. The control system senses this forward rotation of the blade and retracts the hydraulic cylinders that couple the blade to the chassis, causing the blade to return to and maintain its original position. Conversely, when the dozer chassis pitches backwards and the blade begins to tilt backward and rise higher above the ground, the control system extends the hydraulic cylinders coupling the blade to the chassis and lowers the blade, causing the blade to return to and maintain its original position with respect to the earth.

4 Claims, 4 Drawing Sheets

U.S. PATENT DOCUMENTS

| | | | | | |
|---|---|---|---|---|---|
| 5,699,248 | A | | 12/1997 | Nakagami et al. | |
| 5,799,737 | A | * | 9/1998 | Kamikawa et al. | 172/2 |
| 5,816,335 | A | | 10/1998 | Yamamoto et al. | |
| 5,819,190 | A | | 10/1998 | Nakagami et al. | |
| 5,860,480 | A | * | 1/1999 | Jayaraman et al. | 172/2 |
| 5,862,868 | A | * | 1/1999 | Yamamoto et al. | 172/2 |
| 5,875,854 | A | | 3/1999 | Nakagami et al. | |
| 5,880,681 | A | * | 3/1999 | Codina et al. | 340/870.28 |
| 5,935,183 | A | | 8/1999 | Nakagami et al. | |
| 5,950,141 | A | | 9/1999 | Yamamoto et al. | |
| 5,951,612 | A | | 9/1999 | Nakagami et al. | |
| 5,951,613 | A | | 9/1999 | Yamamoto et al. | |
| 5,984,018 | A | | 11/1999 | Sahm et al. | |
| 5,996,703 | A | | 12/1999 | Sahm et al. | |
| 6,112,145 | A | | 8/2000 | Yamamoto et al. | |
| 6,152,238 | A | * | 11/2000 | Ferrell et al. | 172/2 |
| 6,181,999 | B1 | | 1/2001 | Yamamoto et al. | |
| 6,278,955 | B1 | | 8/2001 | Hartman et al. | |
| 6,286,606 | B1 | | 9/2001 | Krieg et al. | |
| 6,295,746 | B1 | | 10/2001 | Meduna et al. | |
| 6,317,676 | B1 | * | 11/2001 | Gengler et al. | 701/82 |
| 6,364,028 | B1 | * | 4/2002 | Ferrell et al. | 172/1 |
| 6,389,345 | B1 | | 5/2002 | Phelps | |
| 6,615,114 | B1 | * | 9/2003 | Skiba et al. | 700/275 |
| 6,655,465 | B1 | | 12/2003 | Carlson | |
| 6,703,939 | B1 | | 3/2004 | Lehrman et al. | |
| 2002/0162668 | A1 | | 11/2002 | Carlson et al. | |

FOREIGN PATENT DOCUMENTS

| | | |
|---|---|---|
| DE | 3827618 A1 | 2/1990 |
| DE | 3827619 A1 | 2/1990 |
| EP | 0327649 A1 | 8/1989 |

* cited by examiner

BULLDOZER AUTOGRADING SYSTEM

FIELD OF THE INVENTION

The invention relates generally to bulldozers. More particularly, it relates to systems for keeping the blade of a bulldozer at a selected position as the bulldozer is operated.

BACKGROUND OF THE INVENTION

"Bulldozers" or "dozers", as those terms are used herein, refer to crawler-tractors that are equipped with a blade for scraping the ground or pushing material along the ground. The blade is pivotally connected to the crawler-tractor chassis such that they can pivot up and down. Blade controls are provided to the operator in the cab of the vehicle. These controls permit the operator raise and lower the blade with respect to the chassis of the crawler-tractor. One of the most common uses for blades on bulldozers is to level or otherwise contour ground for construction of houses, buildings, parking lots, and roads. Often the terrain that the bulldozer starts working is quite uneven and rough. As it passes over this rough terrain, the bulldozer chassis often begins to pitch.

When the chassis pitches up and down, the blade pitches as well. As the blade pitches up the blade digs the earth shallower. As the blade pitches down, it digs into the earth deeper, duplicating in the earth the fluctuations of the dozer chassis as it pitches over the rough terrain. Instead of evenly leveling the terrain, a bulldozer tends to reproduce the very rough terrain over which it drives.

A skilled operator can reduce the pitching of the blade by anticipating the pitching of the chassis and moving the blade in the opposite direction. By manually pitching the blade in a direction opposite to the direction the chassis pitches and at exactly the same time, the operator can grade the terrain more level than if the blade merely pitches with the chassis. This ability to anticipate the motion of the chassis and pitch the blade in the opposite direction takes a good deal of skill, and that skill can only be acquired through experience.

Even a talented driver, however, cannot travel at full speed over rough terrain, but must reduce his speed to accommodate the pitching of the dozer blade as the dozer chassis pitches up and down as it travels over the ground.

The process of leveling the ground using a bulldozer blade is called "grading". Systems for automatically grading the ground have been devised that use sensors mounted on a bulldozer blade and laser light sources located at the corners of a field to be graded. These light sources transmit light to the sensors attached to the bulldozer blade.

As a bulldozer equipped with these systems pitches backward or forward, the blade begins to pitch up or down, causing the light falling on the sensor to fall or rise, respectively. A controller coupled to the sensor controls blade pitching by raising and lowering the blade to keep it in the same position with respect to the ground.

This system, however, requires the careful placement and adjustment of light sources and an unobstructed view of the bulldozer blade.

What the inventors have discovered is that for many applications this laser-guided whole-field system is overkill. Many operators, especially novice operators, would be significantly benefited by a system that merely monitors bulldozer pitching as it goes over rough terrain and keeps the blade in a relatively constant position and at a relatively constant height as the chassis of the bulldozer pitches forward and backward.

What is needed, therefore, is a system for reducing dozer blade pitching as the dozer chassis pitches. What is also needed is a dozer that has a system for reducing dozer blade pitching. What is also needed is a system for keeping the dozer blade at a relatively constant height and at a relatively constant position as the chassis of the tractor-crawler pitches. What is also needed is a system that at least partially relieves the operator of the burden of manually raising and lowering the blade as the vehicle pitches while traveling over the ground. What is also needed is a system that permits the operator to grade faster by automatically controlling blade pitching. What is also needed is a system that automatically controls blade pitching faster than an operator can manually control blade pitching. It is an object of this invention to provide such system and bulldozer.

SUMMARY OF THE INVENTION

In accordance with a first aspect of the invention, a bulldozer is provided, comprising a crawler-tractor; a ground-engaging blade coupled to the crawler to raise and lower with respect to the crawler-tractor; at least one hydraulic lift cylinder configured to position the blade; a blade position sensor to provide a signal indicative of a position of the blade; and an electronic controller coupled to the blade and to the at least one lift cylinder to automatically raise the blade with respect to the crawler-tractor when the crawler-tractor pitches forward, and lower the blade when the crawler-tractor pitches backward, in response to position signals received from the blade position sensor.

The bulldozer may include two horizontally disposed arms pivotally coupled to left and right sides of the crawler-tractor that support the blade, an operator input device coupled to the controller, the input device including a member manually operable to transmit a signal indicative of a target blade position to the controller; wherein the controller includes a feedback control loop configured to drive the blade to a target position. The blade position sensor may be coupled to the controller to transmit the blade position signal to the controller. The controller may be configured to raise and lower the blade in response to the signal indicative of blade position. The signal indicative of blade position may indicate a rate of change of the blade angle that is perpendicular to a generally horizontal axis and laterally extending axis. The operator input device may be configured to generate the signal indicative of the target blade position in a first mode of operation and may be configured to generate a signal indicative of a desired rate of blade lifting in a second mode of operation. The blade position sensor may be fixed to the blade. The controller may include a CPU, RAM, and ROM.

In accordance with a second aspect of the invention, a pitch control system for controlling the pitch of the bulldozer blade is provided, including a blade position sensor configured to be fixed to the blade of the bulldozer to provide a signal indicating an actual position of the blade, a manually operable operator input device configured to be coupled to the controller to provide the controller with a signal indicative of a target position; and an electronic controller configured to be coupled to the blade position sensor and to the input device to receive the target position signal and the actual position signal, to determine the difference between the target position and the actual position and to calculate a valve signal for a hydraulic valve coupled to a blade lift cylinder that will drive the blade to the target position when the bulldozer pitches.

The signal indicating the actual position of the blade may also indicate the angular turning rate of the blade. The controller may include a CPU, a RAM, and a ROM, and the ROM may contain digital instructions that (a) determine the difference between the actual and the target positions and (b) may calculate the valve signal that will drive the blade to the target position. The angular turning rate may be the rate of change of the blade angle that is perpendicular to a generally horizontal axis that extends perpendicular to the length of the crawler-tractor. The blade position sensor may be an angular turning rate sensor. The input device may include a manually operable member that generates a signal that lowers the target position when moved in a first direction, and that raises the target position when moved in a second direction opposite the first direction.

In accordance with a third aspect of the invention, a computer-implemented method of controlling the pitching of a bulldozer blade during movement over the ground is provided, the method including the steps of (1) reading a blade actual position that indicates an actual position of the bulldozer blade; (2) comparing the blade actual position signal with a blade target position signal; (3) determining a hydraulic valve signal that is calculated to drive the blade from the actual position to the target position; and (4) driving the blade to the target position. The step of comparing may include the step of calculating an error signal indicating the difference between the blade's actual position and the blade's target position. The step of determining may include the step of calculating a control signal from the error signal, the control signal having a derivative component, a proportional component, and an integral component. The step of reading a blade actual position may include the step of reading the blade actual position from an angular turning rate sensor and integrating the turning rate to determine the blade actual position. The turning rate may be the rate of turning about a generally horizontal and laterally extending axis.

DETAILED DESCRIPTION OF THE PREFERRED EMBODIMENTS

"Dozer" or "bulldozer" as used herein refers to a crawler-tractor coupled to a blade. "Crawler-tractor" refers to any of the class of work vehicles having a chassis, with an engine and ground-engaging endless-loop tracks that are disposed on either side of the chassis, that are driven by the engine, and that move the chassis over the ground.

"Blade position" and "blade height" are used in the discussion below to refer to the position or height of the blade with respect to the ground on which the bulldozer is supported and the angle of the blade with respect to the chassis and with respect to the horizon. If the crawler-tractor chassis pitches forward, lowering the front of the chassis closer to the ground, the automatic pitch control system disclosed herein raises the blade with respect to the dropping front of the dozer to maintain a relatively constant blade height with respect to the ground. If the chassis pitches backward, raising the front of the chassis, the system lowers the blade to maintain a relatively constant blade height with respect to the ground.

Figure 1:
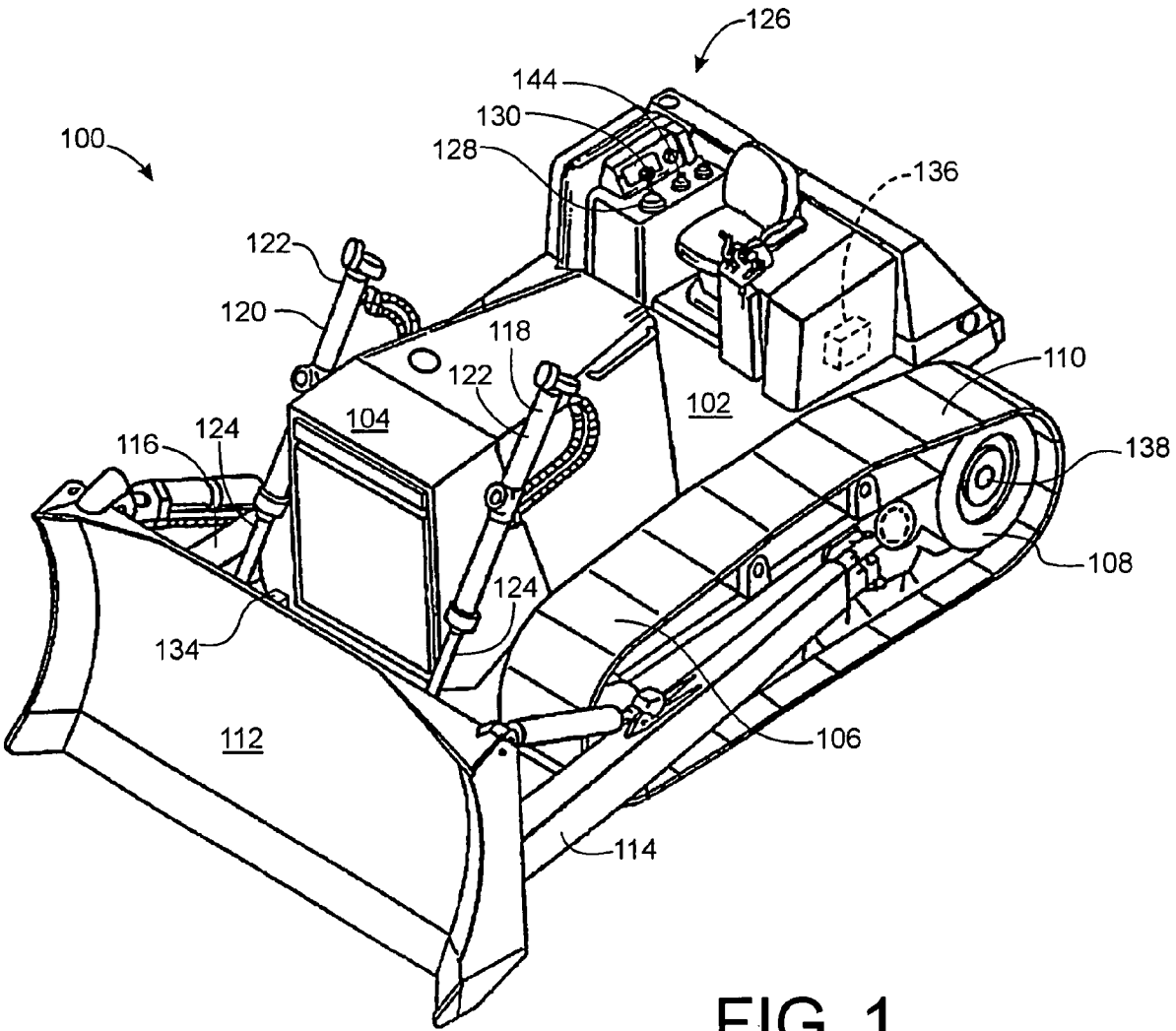
FIG. 1 is a side view of a bulldozer in accordance with the present invention.

Referring to FIG. 1, a dozer 100 is illustrated. The dozer includes a chassis 102 and an engine 104 fixed to the chassis 102. Dozer 100 also includes left side and right side drive systems 106, each of which further includes a drive wheel 108 that is driven by engine 104 and an endless track 110 that is coupled to and driven by the drive wheel. Dozer 100 also includes a laterally extending blade 112 that is mounted to a left arm 114 and a right arm 116. The arms are pivotally coupled to the chassis at their rear ends and are supported at their front ends by left and right hydraulic lift cylinders 118,120.

The left and right cylinder portions 122 of the hydraulic lift cylinders are coupled to the chassis and the left and right rod ends 124 are coupled to the left and right arms. When the operator retracts cylinders 118,120, they shorten in length and lift blade 112. Dozer 100 has an operator's compartment or cab 126 from which the operator operates dozer 100. Among other controls, the cab includes an operator input device 128 that the operator manipulates to raise and lower blade 112.

Device 128 preferably includes a lever 130 having a neutral central position. The operator can move the lever in one direction from neutral to raise the blade and can move the lever in the other direction to lower the blade.

Figure 2:
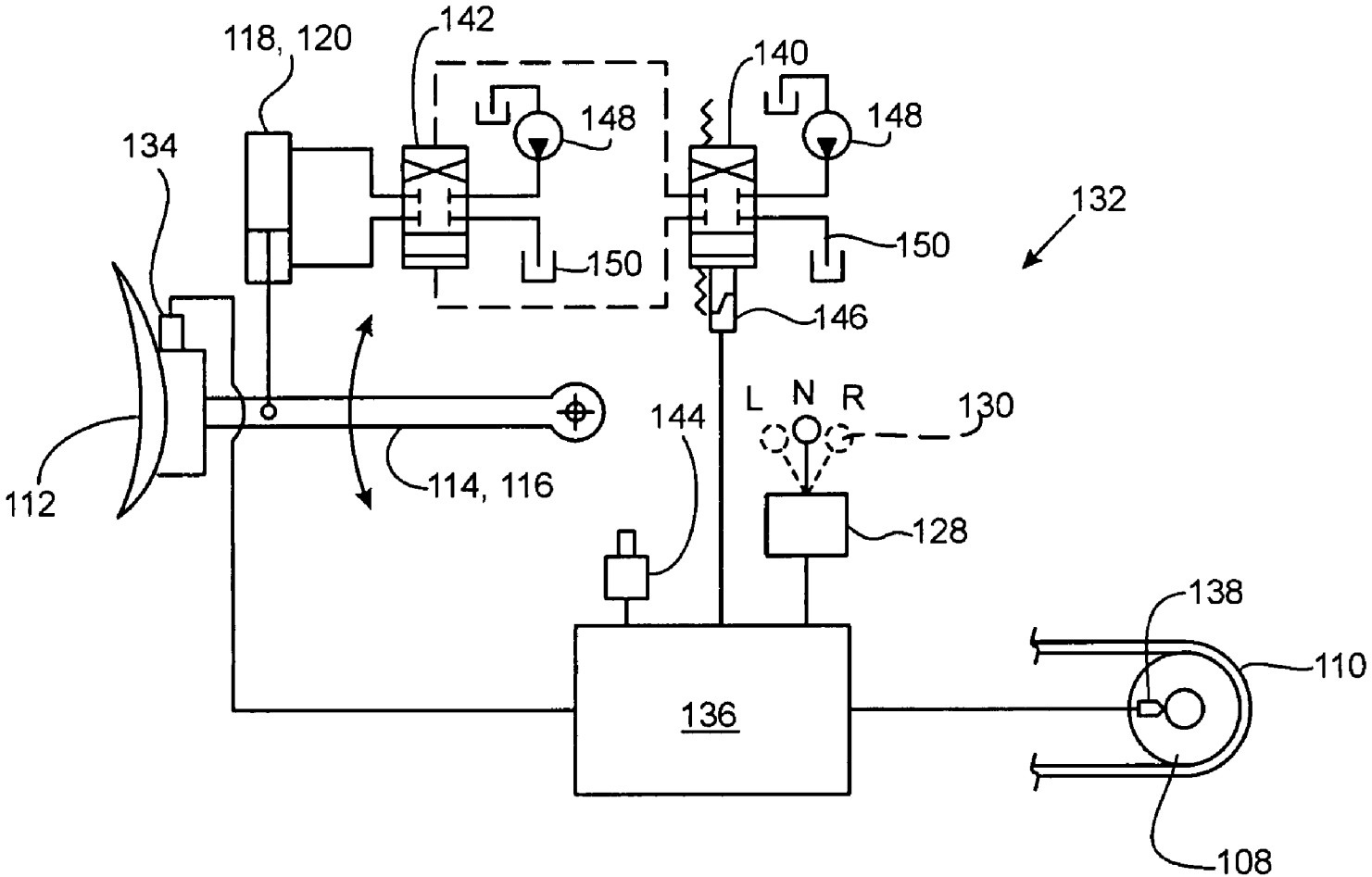
FIG. 2 is a hydraulic and schematic diagram of a blade pitch control system in accordance with the present invention as shown on the bulldozer of FIG. 1.

FIG. 2 shows blade pitch control system 132 in detail. System 132 includes a blade position sensor 134, an electronic controller 136 that is coupled to device 128, a speed sensor 138, a pilot hydraulic valve 140, a main hydraulic valve 142. System 132 also includes an operator switch 144 that is coupled to controller 136.

Electronic controller 136 is a digital microprocessor-based controller, having a RAM, ROM, CPU, sensor input and signal conditioning circuits, valve driver circuits, and serial communications circuits. The sensors and switches are coupled to the sensor input and signal conditioning circuits, the pilot valve is coupled to the valve driver circuits and other digital controllers are coupled to the serial communications circuit. The ROM stores the CPU instructions that constitute the program, the RAM provides working space for the CPU to store values that change during operation, and the CPU executes the program instructions stored in ROM. All these components are coupled together by a data, address and control bus in a conventional manner.

Device 128 preferably includes a variable resistor or shaft encoder coupled to lever 130 to provide a signal proportional to (and indicative of) lever position. This signal is provided to controller 136 on the signal line coupling the two. Lever 130 is mounted to pivot about a pivotal axis when grasped and deflected by the operator.

Lever 130 is preferably spring loaded such that it returns to a central neutral position when released by the operator. In this way, movement in one direction away from the neutral position is identified by controller 136 as a request to raise blade 112 and movement in the other direction is identified by controller 136 as a request to lower blade 112.

Speed sensor 138 is coupled to wheel 108 to provide a signal indicative of wheel speed and vehicle speed. Sensor 138 may be a Hall Effect device, shaft encoder, or other device configured to indicate the rotational speed and direction (velocity) of wheel 108 or the speed of the vehicle.

Pilot hydraulic valve 140 includes a coil 146 that is coupled to the valve driver circuit of controller 136. Valve 140 is a proportional control valve that regulates flow in both directions through valve 140. The output of pilot valve 140 is applied to both ends of main hydraulic valve 142. The output of valve 140 opens valve 142 proportional to the magnitude and direction of the signal applied to coil 146 of valve 140. Thus, the greater the signal applied to coil 146, the faster the movement of blade 112. In a preferred arrangement, a bulldozer can be retrofitted with a blade pitch control system such as that described herein, by coupling pilot hydraulic valve 140 to an existing bulldozer blade control system to that bulldozer's existing main hydraulic valve 142. In this manner, the operator can use the bulldozer's existing blade control input devices to drive the bulldozer's existing valve 142 and control the bulldozer blade position, or the operator can release those controls (which may be electrical, mechanical, fluidic or a combination of any of the three) and control the blade using the blade control system described herein.

The movement of the valves (and hence the blade) is a function not just of the magnitude of the applied signal but also the direction of the signal. If the signal is applied in one direction, the blade moves upward. If the signal is applied in the opposite direction, the blade moves downward.

Blade movement is therefore proportional to, and in the direction indicated by, the electrical signal which controller 136 applies to coil 146.

Blade position sensor 134 provides a signal indicative of the position of the blade—preferably, the angle of the blade or the rate of change of the blade angle as it pitches forward and backward. Blade position sensor 134 preferably includes an angular or rotational turning rate sensor, a sensor that senses the rate of rotation about an axis. Such sensors include, for example, pitch, yaw, or roll rate sensors. In the preferred embodiment, the sensor is fixed to the side-to-side center of the blade and is responsive to the pitching of the bulldozer blade about a lateral (side-to-side) axis.

Whenever the blade is either raised or lowered with respect to the chassis, the entire blade rotates about a lateral axis defined by the trailing ends of the two arms that support the blade. The trailing ends of these arms are rotationally coupled to the chassis of the crawler-tractor. Whenever the hydraulic lift cylinders are extended or retracted, the blade, in effect, rotates about a generally horizontal and lateral axis defined by the pivot points where the bulldozer arms are coupled to the chassis.

Similarly, whenever the chassis itself pitches forward or backward going over a stump or rock, for example, the blade also rotates about the generally horizontal and lateral axis.

In both of these cases, the position sensor is mounted to the blade to sense the blade's angular rotation about a lateral axis and transmits a signal indicative of this movement to controller 136. Whether the blade tilts (i.e. rotates) forward and moves downward toward the ground or tilts (i.e. rotates) backward and moves away from the ground due to (1) extending or retracting the hydraulic lift cylinders or (2) because the chassis of the vehicle pitches, makes no difference: the effect is the same. The angular rotation of the blade with respect to a lateral axis is proportional to the blade's height. Thus, the height of the blade can be maintained in a generally constant position by maintaining the blade at a constant angle of tilt or pitch.

If the blade position sensor 134 is a rate sensor, its rate of rotation signal may be integrated by (or at) the sensor itself to provide an absolute position signal. Alternatively, the signal may be transmitted to controller 136 as a rate of rotation signal and integrated by (or at) controller 136 to provide a signal that indicates absolute blade position (angle).

Operator switch 144 has an "off" and an "on" position. When the switch is in the "on" position, the switch signals controller 136 to automatically reduce blade pitching. When switch 144 is in the "off" position, the switch signals to controller 136 that the controller should not automatically reduce blade pitching. Alternatively, the system can include a gyro rate control. The gyro rate control can be used to adjust sensitivity.

When the operator switch is in the "off" position, however, direct control of blade 112 position is possible by operator manipulation of device 128 by lever 130. Controller 136 applies a signal to coil 146 proportional to and in the direction indicated by the movement of lever 130 of input device 128. When the controller senses that the operator has moved lever 130 in the "R" direction, controller 136 signals coil 146 to raise the blade at a speed proportional to the deflection of lever 130 in the R" direction. When the controller senses that the operator has moved lever 130 in the "L" direction, controller 136 signals coil 146 to lower the blade at a speed proportional to the degree of deflection of lever 130 in the "L" direction. Thus, when switch 144 is "off", controller 136 is configured to move the blade up-and-down at a rate that corresponds to the degree of deflection of lever 130. In this mode, lever 130 signals the rate at which blade 112 rises and falls When the operator switch is in the "on" position, controller 136 controls blade pitching by monitoring the blade's angular position with sensor 134 and driving the blade up or down with valve 140, to keep it at a generally constant angle with respect to the earth. This automatic pitch control is described below in conjunction with FIGS. 3 and 4.

When the switch is in the "on" position, controller 136 operates, generally, by (1) receiving signals indicative of blade position from blade position sensor 134, (2) receiving signals indicative of a preferred or target blade position from device 130 and (3) combining the two signals to keep blade 112 at the preferred or target position.

Controller 136 determines the operator's preferred blade position from the signals that are provided by input device 128. It compares that position with the actual blade position and, based upon the difference between the two, drives the blade to the target position. It does this by controlling pilot valve 140, which in turn controls main valve 142, which in turn controls hydraulic lift cylinders 118, 120, which in turn raise and lower blade 112 with respect to the crawler-tractor.

Control system 132 is coupled to a source of hydraulic fluid 148. This source includes a hydraulic pump that is driven by the bulldozer's engine. The system is also coupled to a hydraulic fluid reservoir 150 to which fluid is returned. The source 148 and reservoir 150 are coupled to the valves to provide the hydraulic fluid used to operate the valves and the hydraulic cylinders.

The components described above, including the blade position sensor 134, the electronic controller 136, operator input device 128, speed sensor 138, pilot hydraulic valve 140, main hydraulic valve 142, and operator switch 144, collectively constitute pitch control system 132.

Primary Pitch Control Mode

Figure 3:
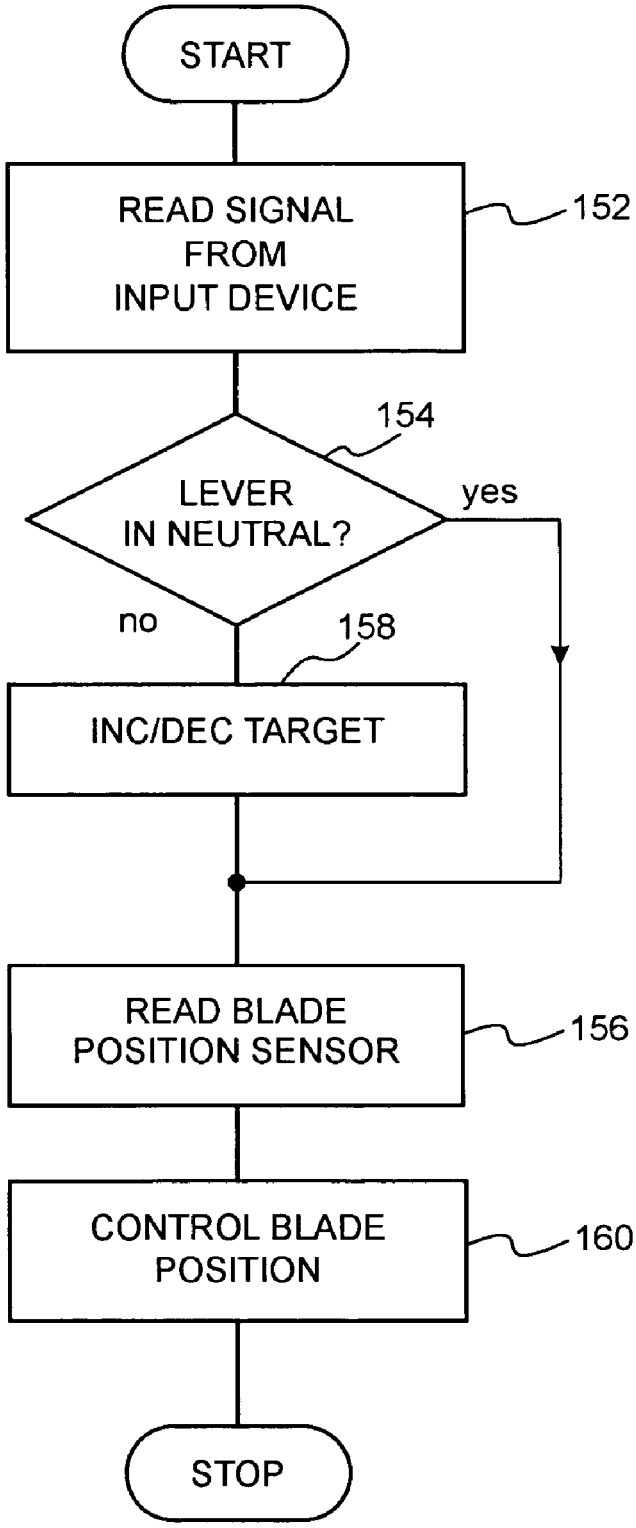
FIG. 3 is a flowchart of the functions performed by the controller of FIG. 2 when it executes its stored program and controls blade pitching.

FIG. 3 is a flow chart illustrating the programming of controller 136 and the operation of the blade pitch control system. Controller 136 is configured to execute the steps shown in FIG. 3 whenever the operator switch 144 is in the "on" position. The steps shown in FIG. 3 are repeated by controller 136 on a preferred interval of 10 to 100 milliseconds.

In the first step 152 of FIG. 3, controller 136 reads the signal from the input device 128, which indicates whether the operator is requesting that the blade be raised, lowered, or held in the same position. In step 154, controller 136 checks the signal from input device 128 to see if lever 130 is in neutral. Due to its spring loading, lever 130 remains in its neutral position until the operator moves it to another position and returns to neutral when released.

If the lever is in neutral, the process continues to step 156, if is not in neutral, controller 136 continues to step 158. In step 158, controller increments or decrements "TARGET", a digital value stored in the memory of controller 136 (and identified herein for convenience as "TARGET") that indicates the operator's preferred or target position for blade 112.

Controller 136 increments TARGET if the operator has moved lever 130 in the "raise" ("R" in FIG. 2) direction from the neutral position ("N" in FIG. 2). Controller 136 increments TARGET an amount proportional to the distance that lever 130 is deflected in the "raise" direction. Controller 136 decrements TARGET if the operator has moved lever 130 in the "lower" ("L" in FIG. 2) direction from the neutral position. Controller 136 decrements TARGET an amount proportional to the distance that lever 130 is deflected in the "lower" direction.

Once controller 136 has changed TARGET, processing continues with step 156. In step 156, controller 136 reads the signal from the blade position sensor 134. This signal generally indicates the actual position of the blade with respect to the ground. Controller 136 then stores the value of this signal in a memory location in controller 136 identified for convenience herein as "ACTUAL" herein. Whenever the vehicle pitches forward, the blade both moves downward and tilts forward at the same time. Whenever the blade is lowered using hydraulic lift cylinders 118, 120, the blade is not only lowered but also tilted forward. In both cases, the angle of the blade indicates the blade's position.

Having read the signal from sensor 134 in step 156, controller 136 proceeds to step 160, which represents the feedback control loop executed by controller 136 for controlling the position of blade 112. In step 160, controller compares the actual position of the blade derived from the signal of sensor 134 to the target position of the blade provided by the value TARGET stored in the controller's memory circuits. If the blade is not at the target position (TARGET), controller 136 is programmed to open pilot valve 140 an amount appropriate to incrementally move the blade back to its target position.

As the blade moves back toward its target position with each iteration of the steps of FIG. 3, the actual blade position (ACTUAL) that controller 136 reads in step 156 gets closer and closer to the target position (TARGET). This process is called "feedback control" and the repeated iterations through steps 156 and 160 are called a "feedback control loop" or "feedback control algorithm". They are called this since (1) the controller repeatedly loops through the steps and (2) the process relies upon feedback from the physical system being controlled (i.e. the position of the blade and hence the signal from sensor 134) to determine the appropriate control actions to be taken. In this example, the control action taken by controller 136 is closing or opening valve 140.

Figure 4:
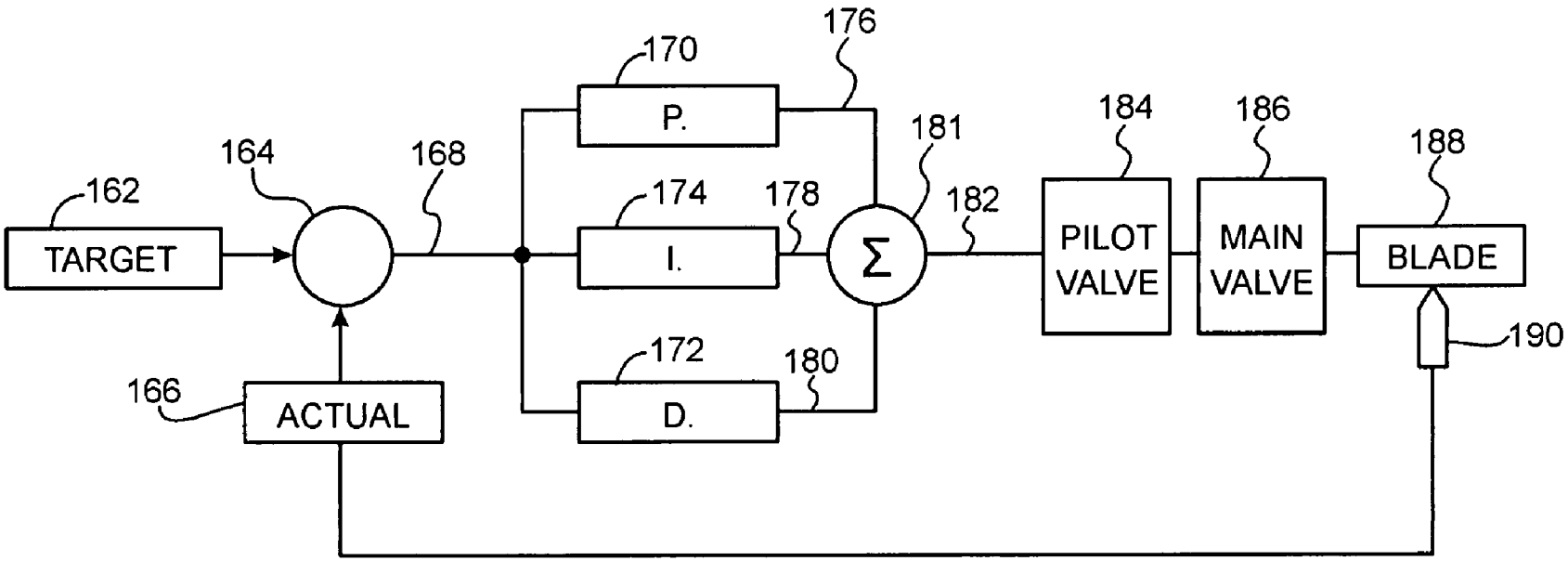
FIG. 4 is a control diagram illustrating the control operations performed by the electronic controller of FIG. 3 that regulate the pitch of the blade.

FIG. 4 is a control diagram of the PID (proportional-integral-derivative) feedback control loop executed by controller 136.

While this particular control loop is representative of a typical feedback control algorithm, it should be understood that it is just one of many automatic feedback control algorithms that may be used to control blade position. The selection of an appropriate feedback control algorithm depends upon many factors, including the particular size, shape, and mass of the structures being controlled (e.g. the blade 112 and the arms); the configuration and capacity of the devices controlling them (e.g. the hydraulic valves 140, 142 and cylinders 118, 120); and the speed, resolution, and accuracy of the sensors and instrumentation (e.g. blade position sensor 134).

The control loop of FIG. 4 is preferably implemented in software, in which the control loop items shown in FIG. 4 are programming constructs. In the control diagram, the target blade position, "TARGET", (162) is summed at junction 164 with the actual blade position, "ACTUAL", (166) provided by sensor 134 to provide an error signal on line 168. This error signal is provided to a proportional gain block 170, a differential block 172 and an integral block 174.

The blade position can be expressed in absolute terms or in relative terms as an angle or a distance. The units used by controller 136 are immaterial. What is important is that whatever units are used, the blade position (height or angular rotation) be kept generally constant in the vicinity of TARGET.

The proportional block generates an output on line 176 that is proportional to the error signal. The derivative block generates an output on line 178 that is proportional to the derivative of the error signal (the time rate of change of the error signal), and the integral block generates an output on line 180 that is proportional to the integral of the error signal (the sum of the errors over time). Summing junction 181 combines the proportional, the integral, and the derivative components of the signal and provides that combined signal on line 182. The combined signal is then applied to pilot valve 140 (block 184). When pilot valve 140 changes its position, it changes the position of main hydraulic valve 142 (block 186), which changes the position of blade 112 (block 188), by moving it up or down. When blade 112 changes position, it moves position sensor 134 (block 190) which is coupled to the blade. Sensor 134 responds accordingly by generating a signal indicating the new actual position (ACTUAL) of the blade.

To summarize the operation of the automatic pitch control system shown in FIGS. 3 and 4, the system has a preferred or target blade position (TARGET) to which it constantly drives the blade.

Whenever the chassis of the vehicle pitches forward, the blade position sensor 134 senses the forward rotation (or pitching) of the blade about a lateral axis as the blade drops towards the ground. Controller 136 executes a feedback control loop to correct the blade's position using the hydraulic valves and the hydraulic lift cylinders to retract the hydraulic cylinders and to lift the blade upward. This has a double effect of maintaining the blade at a generally constant angle of tilt and maintaining the blade at a generally constant height relative to the earth.

Similarly, when the vehicle's chassis pitches backwards, it causes the blade to tilt backwards and the blade to lift higher above the ground. Blade position sensor 134 senses this backwards rotation of the blade of and signals controller 136. Controller 136, in turn, executes the feedback control loop to correct the blade's position by extending the hydraulic cylinders and lowering the blade downward toward the ground. This also has the double effect of maintaining the blade at a generally constant angle of tilt with respect to the earth and maintaining the blade at a generally constant height with respect to the earth.

The operator can change the target blade position by moving lever 130. Whenever the target blade position changes, the control loop executed by controller 136 responds by automatically controlling the position of the blade.

When the operator switch is in the "off" position, controller 136 commands the valves to open (and hence the blade to move) in a direction proportional to the degree of deflection of lever 130 from its neutral position. If the bulldozer chassis pitches when the operator switch is in the "off" position, the hydraulic cylinders do not move with respect to the chassis. The blade pitches just as the chassis pitches, either digging deeper into the ground when the chassis pitches forward or rising up out of the ground when the chassis pitches backward.

Automatic TARGET Determination

In the example illustrated above, the target position of the blade is selected manually by the operator who can change the target blade position at any time by operating the input device. However, in an alternative mode of operation, controller 136 is configured to automatically determine the initial blade position in automatic pitch control mode based upon the average blade position during manual operation.

In this alternative mode of operation, controller 136 is configured to periodically read the actual position of the blade from sensor 134 during manual operation of the bulldozer (i.e. when switch 144 is turned off). During this manual operation, the operator gradually adjusts the blade position over time with input device 128 until he finds the optimum blade position.

As the operator adjusts the blade during manual operation, controller 136 is configured to automatically read successive blade positions (i.e. the blade position signal) over a period of time. Controller 136 is configured to average these successive signals to determine an average actual blade position. Controller 136 is therefore aware of the operator's desired blade position even before the operator turns the blade pitch control system "on". Once the operator engages the blade pitch control system by turning switch 144 "on", controller 136 already knows the current height of the blade and can immediately take over and keep the blade at that height.

Once the pitch control system is turned on, controller 136 uses the position it calculated during manual mode as its initial target blade position (TARGET). Thus, from the moment the operator turns the automatic pitch control system "on", controller 136 starts controlling the blade position to keep the blade at the same position that the operator was manually keeping it.

Alternative Pitch Control Mode

In the example illustrated in FIGS. 3–4 above, the target position of the blade is changed by the operator whenever the operator manipulates input device 128. In the automatic pitch control mode, whenever the operator moves lever 130 up or down, the target blade position (TARGET) changes up or down, responsively.

In an alternative configuration, however, controller 136 is configured to change the target position (TARGET) when the input device is moved in one direction, but not to change the target position when the operator moves the lever in the other direction. In this mode, whenever the operator moves lever 130 in the "L" (or "lower") direction, for example, controller 136 responds by lowering the target position (TARGET) of the blade. Controller 136 continues controlling blade pitching, but does so with a new and lower target blade position.

When the operator moves lever 130 of input device 128 in the "R" or "raise" direction, however, controller 136 is configured to not change (i.e. to not raise) the target blade position. Instead, controller 136 raises the blade as though the switch 144 was "off", and temporarily ceases to automatically control blade position. Controller 136 remembers the target blade position, however, and does not change it. Controller 136 just ceases to drive the blade to the target position until the operator again signals his desire for automatic blade pitch control.

In this alternative configuration, controller 136 interprets the operator's upward movement of lever 130 not as a request to raise or increase the target blade position, but as a request to (1) temporarily raise the blade to avoid obstructions, and (2) temporarily disable automatic pitch control until the obstruction is passed.

The operator can continue through the field for any distance with the blade held by controller 136 in this raised position. Controller 136 will not begin automatically controlling blade pitch again until the operator signals controller 136 to restart automatic control using lever 130 in a special manner.

In this way the operator does not have to turn the automatic pitch control "off" with switch 144, then raise the blade, then wait for the obstruction to pass, then turn the automatic blade pitch control "on" again with switch 144 when he wishes to return to automatic pitch control at the original height.

The operator signals his desire to restart automatic blade pitch control in a manner opposite the way he signaled his desire to leave automatic blade pitch control.

When the operator wishes to turn automatic blade pitch control back on in this alternative configuration, he moves lever 130 in the "L" (lower) direction (again, without manipulating switch 144). Controller 136 responds to this lever movement in the "L" direction by lowering the blade just as it does when switch 144 is "off" and without changing the target blade position.

With the operator holding lever 130 in the "L" position, the controller begins to lower the blade toward its target blade position. The blade eventually drops to the target blade position. Controller 136 is aware of this approach toward the target blade position since controller 136 is configured to continuously monitor the actual blade position during this blade descent. As the blade descends, controller 136 is configured to compare the actual blade position with the (lower) target blade position.

Eventually controller 136 determines that the blade is within a small and predetermined distance of the target blade position. At this point, controller 136 stops functioning as though switch 144 is "off", and restarts its automatic control of blade position.

Once controller 136 has restarted its automatic control of blade position, if the operator releases lever 130 of input device 128 the controller merely continues automatically controlling the blade position.

Alternatively, if the operator does not release lever 130 but keeps holding it in the "L" position once automatic control has been reengaged, controller 136 does not keep lowering the blade, but controls the blade height at the target blade position.

To summarize the operation in this alternative automatic pitch control mode, the operator can lower the target blade position with lever 130, but cannot raise the target blade position by moving lever 130 in the "raise" direction. Instead, when the operator raises the lever that signals controller 136 to (1) raise blade 112 above the target blade position and (2) immediately stop moving the blade just as though the blade pitch control is disabled when the operator releases lever 130. The purpose of this operating mode is to permit the operator to briefly raise the blade above stumps, rocks, or other protrusions, to temporarily disable automatic blade positioning without changing the target blade height and to permit restarting of automatic blade pitch control without having to manipulate switch 144.

Assuming the operator wishes to lower the blade further (i.e. below the current target blade position the controller 136 has locked onto), the operator must first release lever 130, permitting it to return to the neutral position. This return to neutral is immediately sensed by controller 136.

Once controller 136 senses the blade had returned to neutral, it keeps controlling the blade position automatically, but permits the operator to (1) lower the blade and the target blade position by moving the lever in the "L" direction, or (2) raise the blade above the target blade position by moving the lever in the "R" direction. If the operator wishes to keep lowering the blade in the automatic mode once the controller has "locked on", he must first release the lever. In another alternative embodiment, when the operator lowers the blade to within the small and predetermined distance of the target blade position, the system does not automatically begin controlling blade position at the target blade height before the operator releases the lever, but waits until the operator releases the lever, permitting it to return to its neutral position.

In another alternative embodiment, the speed sensor senses the vehicle's speed through the field and provides it to controller 136. Controller 136, in turn, changes the response rate of its PID control loop to respond faster when the vehicle is moving faster through the field, and to respond slower when the vehicle is moving slower through the field.

In yet another alternative embodiment, a GPS can be coupled to controller 136 to provide location information to controller 136 that could provide better information on the vehicle's path through the field.

It will be understood that changes in the details, materials, steps, and arrangements of parts which have been described and illustrated to explain the nature of the invention will occur to and may be made by those skilled in the art upon a reading of this disclosure within the principles and scope of the invention.

For example, rather than providing a blade position sensor that is responsive to the blade being raised and lowered and responsive to the blade pitching about a substantially lateral axis, a blade position sensor can be provided that is responsive to rotating about a longitudinal axis, or "rolling". In this case, the blade position sensor would sense the rolling of the blade about a longitudinal axis such as occurs when one side of the bulldozer is raised above the other side. This happens, for example, when the track on one side of the bulldozer runs over our rock or a stump. Many bulldozers are configured with hydraulic cylinders coupled to the blade that control the blade's roll angle. These hydraulic cylinders cause one side of the blade to raise and the other side of the blade to lower. In this arrangement, if the chassis begins to roll to the right, with the left side tracks being lifted higher above the ground than the right side tracks, controller 136 will sense the corresponding rolling of the blade to the right by monitoring this alternative or additional blade position sensor that senses rotation about the blade's longitudinal axis. Using the same control algorithm described above with regard to bulldozer pitching, controller 136 is configured to maintain the roll angle of the blade constant.

In a second alternative arrangement, a blade control system can be provided with a blade position sensor responsive to rotation about a longitudinal axis and rotation about a lateral axis (such as illustrated herein). In this arrangement, electronic controller 136 could be coupled to both of these blade position sensors, and could be configured to execute two PID control loops, one controlling rotation around the longitudinal axis and the other controlling rotation around the lateral axis. In effect, controller 136 would control the height of the blade as well as its left to right tilt angle.

The position sensor is shown as a single physical device coupled to the center of the blade of the bulldozer. In an alternative embodiment, the position sensor 134 may be located elsewhere, such as a long the dozer arms, or it may comprise two physical devices, one device to provide chassis position and one disposed to provide a position signal indicative of the difference between the chassis position and the blade's position. These two devices may include a position sensor, such as item 134, coupled to the dozer chassis and an angle sensor coupled between the blade and the chassis to provide a chassis-to-blade angle signal. By combining signals from these two physical devices, one showing or indicating the dozer chassis position with respect to the ground, and the other showing or indicating the position of the blade with respect to the chassis, the system described herein would function just as well.

The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

We claim:

1. A bulldozer with a blade pitch control system, comprising:

a crawler-tractor;

a ground-engaging blade coupled to the crawler-tractor and configured to raise and lower with respect to the crawler-tractor;

at least one hydraulic lift cylinder configured to position the blade;

a blade position sensor configured to provide a signal indicative of a position of the blade;

an electronic controller coupled to the blade position sensor and to the at least one lift cylinder to (1) continuously adjust the blade with respect to the crawler-tractor when the crawler-tractor pitches forward, in response to the signal indicative of a position of the blade and (2) continuously adjust the blade with respect to the crawler-tractor when the crawler-tractor pitches backward, in response to the signal indicative of a position of the blade, the controller is configured to continuously adjust the blade in response to a difference between the signal indicative of the target blade position and the signal indicative of the blade, wherein the signal indicative of a position of the blade indicates a rate of changes of an angle of the blade that is perpendicular to a generally horizontal and laterally-extending axis;

two horizontally disposed arms pivotally coupled to the left and right sides of the crawler-tractor, said arms supporting the blade; and an operator input device coupled to the controller, the input device including a member manually operable to transmit a signal indicative of a target blade position to the controller, the operator input device is further configured to generate the signal indicative of the target blade position in a first mode of operation and to generate a signal indicative of a desired rate of blade lifting in a second mode of operation, wherein the controller has a feedback control loop configured to continuously adjust the blade to the target blade position.

2. The bulldozer of claim 1, wherein the blade position sensor is fixed to the blade.

3. The bulldozer of claim 2, wherein the controller includes a CPU, RAM and ROM.

4. A pitch control system for controlling the pitching of a blade of a bulldozer, comprising:

a blade position sensor configured to be fixed to the blade of the bulldozer to provide a signal indicating an actual position of the blade;

a manually operable operator input device configured to provide a signal indicating a target position, wherein the input device includes a manually operable member that lowers the target position when moved in a first direction and raises the target position when moved in a second direction opposite the first direction; and an electronic controller coupled to the blade position sensor, wherein the blade position sensor is an angular rate sensor and to the input device to (1) receive the target position signal and the actual position signal, (2) to determine a difference between the target position and the actual position and (3) to calculate a valve signal for a hydraulic valve coupled to a blade lift cylinder that will continuously adjust the blade from the actual blade position toward the target blade position, wherein the controller further includes a CPU, a RAM and a ROM, and further wherein the ROM stores digital instructions that (a) determine the difference between the target position and the actual position and (b) calculate the valve signal that will drive the blade to the target position.

* * * * *